US006996524B2

(12) United States Patent
Gigi

(10) Patent No.: US 6,996,524 B2
(45) Date of Patent: Feb. 7, 2006

(54) SPEECH ENHANCEMENT DEVICE

(75) Inventor: Ercan Ferit Gigi, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 650 days.

(21) Appl. No.: 10/116,596

(22) Filed: Apr. 4, 2002

(65) Prior Publication Data

US 2002/0156624 A1 Oct. 24, 2002

(30) Foreign Application Priority Data

Apr. 9, 2001 (EP) ..... 01201304

(51) Int. Cl.
*G10L 21/02* (2006.01)

(52) U.S. Cl. ..... 704/226; 704/227

(58) Field of Classification Search ..... 704/226; 395/2.35
See application file for complete search history.

(56) References Cited

U.S. PATENT DOCUMENTS 5,706,395 A 1/1998 Arslan et al. ..... 395/2.35
6,175,602 B1 1/2001 Gustafsson et al. ..... 375/346

FOREIGN PATENT DOCUMENTS

EP 1065656 A2 5/1995

OTHER PUBLICATIONS

Gerhard Doblinger; "Computationally Efficient Speech Enhancement by Spectral Minima Tracking in Subbands", Technische Universitat Wien Vienna Austria, XP-000854989.

*Primary Examiner*—Susan McFadden
(74) *Attorney, Agent, or Firm*—Michael J. Ure

(57) ABSTRACT

A speech enhancement system for the reduction of background noise comprises a time-to-frequency transformation unit to transform frames of time-domain samples of audio signals to the frequency domain, background noise reduction means to perform noise reduction in the frequency domain, and a frequency-to-time transformation unit to transform the noise reduced signals back to the time-domain. In the background noise reduction means for each frequency component a predicted background magnitude is calculated in response to the measured input magnitude from the time-to-frequency transformation unit and to the previously calculated background magnitude, whereupon for each of said frequency components the signal-to-noise ratio is calculated in response to the predicted background magnitude and to said measured input magnitude and the filter magnitude for said measured input magnitude in response to the signal-to-noise ratio. The speech enhancement device may be applied in speech coding systems, particularly $P^2CM$ coding systems.

7 Claims, 3 Drawing Sheets

SPEECH ENHANCEMENT DEVICE

The present invention relates to a speech enhancement device for the reduction of background noise, comprising a time-to-frequency transformation unit to transform frames of time-domain samples of audio signals to the frequency domain, background noise reduction means to perform noise reduction in the frequency domain, and a frequency-to-time transformation unit to transform the noise reduced audio signals from the frequency domain to the time-domain.

Such a speech enhancement device may be applied in a speech coding system e.g. for storage applications such as in digital telephone answering machines and voice mail applications, for voice response systems, such as in "in-car" navigation systems, and for communication applications, such as internet telephony.

In order to enhance the quality of noisy speech recording, the level of noise has to be known. For a single-microphone recording only the noisy speech is available. The noise level has to be estimated from this signal alone. A way of measuring the noise is to use the regions of the recording where there is no speech activity and to compare and to update the spectrum of frames of samples during speech activity with those obtained during non-speech activity. See e.g. U.S. Pat. No. 6,070,137. The problem with this method is that a speech activity detector has to be used. It is difficult to build a robust speech detector that works well, even when the signal-to-noise ratio is relatively high. Another problem is that the non-speech activity regions might be very short or even absent. When the noise is non-stationary, its characteristics can change during speech activity, making this approach even more difficult.

It is further known to use a statistical model that measures the variance of each spectral component in the signal without using a binary choice of speech or non-speech; see: Ephraim, Malah; "Speech Enhancement Using MMSE Short-Time Spectral Amplitude Estimator", IEEE Trans. on ASSP, vol. 32, No. 6, December 1984. The problem with this method is that, when the background noise is non-stationary, the estimation has to be based on the most adjacent time frames. In a length speech utterance some regions of the speech spectrum may always be above the actual noise level. This results in a false estimation of the noise level for these spectral regions.

The purpose of the invention is to predict the level of the background noise in single-microphone speech recording without the use of a speech activity detector and with a significantly reduced false estimation of the noise level.

Therefore, according to the invention, the speech enhancement device, as described in the opening paragraph, is characterized in that the background noise reduction means comprise a background level update block to calculate, for each frequency component in a current frame of the audio signals, a predicted background magnitude B[k] in response to the measured input magnitude S[k] from the time-to-frequency transformation unit and in response to the previously calculated background magnitude $B_{-1}[k]$, a signal-to-noise ratio block to calculate, for each of said frequency components, the signal-to-noise ratio SNR[k] in response to the predicted background magnitude B[k] and in response to said measured input magnitude S[k] and a filter update block to calculate, for each of said frequency components, the filter magnitude F[k] for said measured input magnitude S[k] in response to the signal-tonoise ratio SNR [k].

The invention further relates to a speech coding system and to a speech encoder for such a speech coding system, particularly for a $P^2CM$ audio coding system, provided with a speech enhancement device according to the invention. Particularly the encoder of the $P^2CM$ audio coding system is provided with an adaptive differential pulse code modulation (ADPCM) coder and a pre-processor unit with the above speech enhancement system.

These and other aspects of the invention will be apparent from and elucidated with reference to the drawing and the embodiment described hereinafter. In the drawing.

Figure 6:
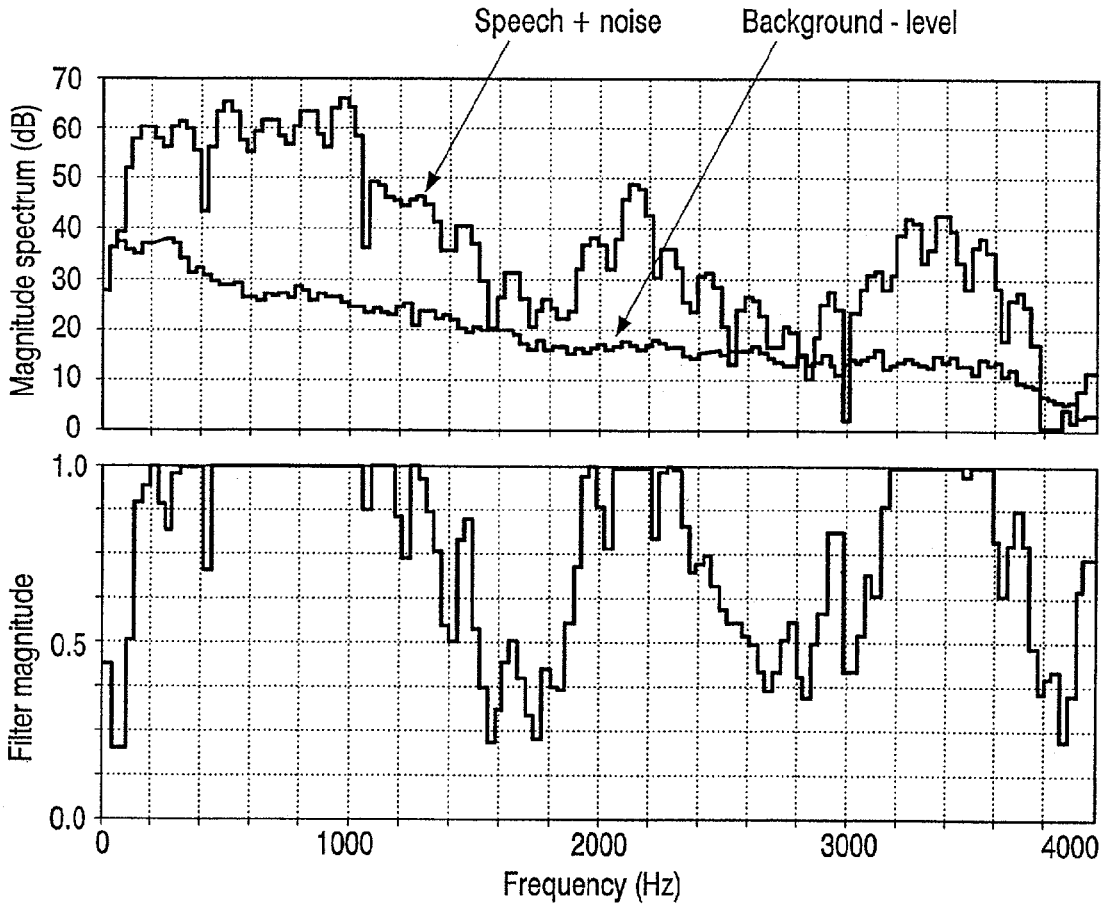

FIG. 6 a voice speech segment contaminated with background noise with the measured background-level and the resulting frequency-domain filtering.

As an example, in the speech enhancement device, the audio input signal hereof is segmented into frames of e.g. 10 milliseconds. With e.g. a sampling frequency of 8 kHz a frame consists of 80 samples. Each sample is represented by e.g. 16 bits.

The BNS is basically a frequency domain adaptive filter. Prior to actual filtering, the input frames of the speech enhancement device have to be transformed into the frequency domain. After filtering, the frequency domain information is transformed back into time domain. Special care has to be taken to prevent discontinuities at frame boundaries since the filter characteristics of the BNS will change over time.

Figure 1:
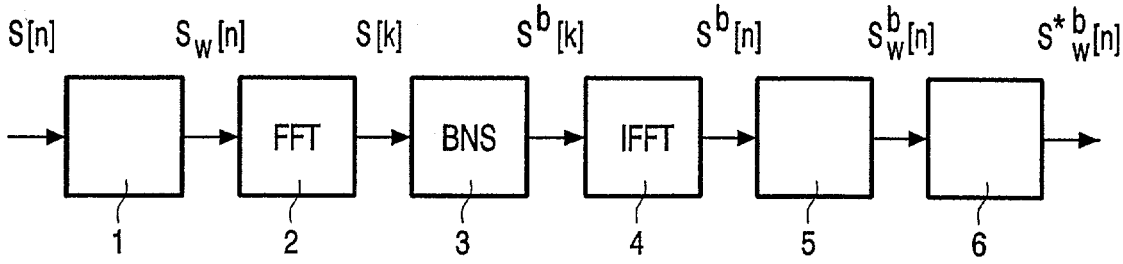
FIG. 1 shows a basis block diagram of a speech enhancement device with a stand-alone background noise subtractor (BNS) according to the invention.

FIG. 1 shows the block diagram of the speech enhancement device with BNS. The speech enhancement device comprises an input window forming unit 1, a FFT unit 2, a background noise subtractor (BNS) 3, an inverse FFT (IFFT) unit 4, an output window forming unit 5 and an overlap-an-add unit 6. In the present example the 80 samples input frames of the input window forming unit 1 are shifted into a buffer of twice the frame size, i.e. 160 samples to form an input window s[n]. The input window is weighted with a sine window w[n]. In the present example the spectrum S[k] is computed using a 256-points FFT 2. The BNS block 3 applies frequency domain filtering on this spectrum. The result $S^b[k]$ is transformed back into time domain using the IFFT 4. This gives the time domain representation $s^b[n]$. In the unit 5 the time-domain output is weighted with the same sine window as the one used for the input. The net result of weighting twice with a sine window results in weighting with a Hanning window. The output of the unit 5 is represented by $s^b_w[n]$. A Hanning window is the preferred window type used for the next processing block 6: overlap-and-add. Overlap-and-add is used to get a smooth transition between two successive output frames. The output of the overlap-and-add unit 6 for frame "i" is represented by:

$$s^{*b}_{w,i}[n]=s^b_{w,i}[n]+s^b_{w,i-1}[n+80] \text{ with } 0\leqq n\leqq 80.$$

Figure 2:
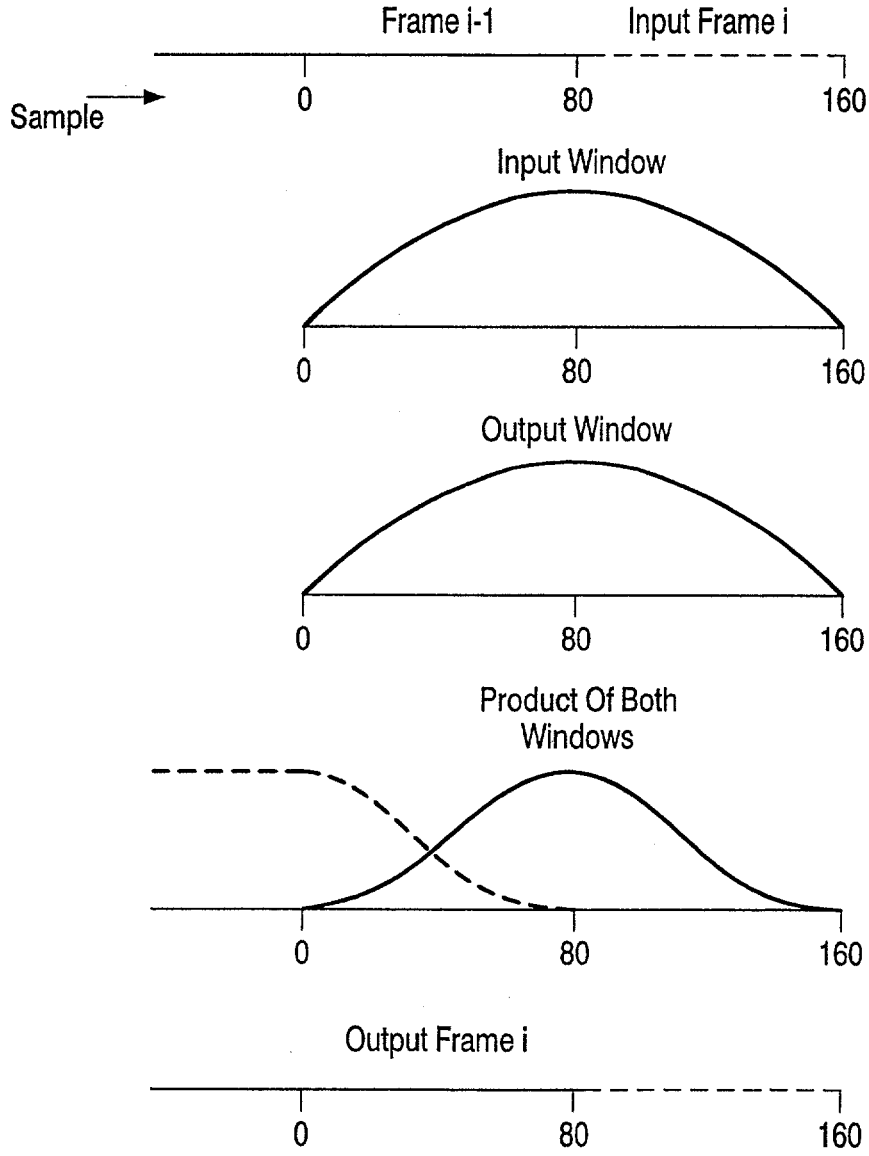
FIG. 2 shows the framing and windowing in the BNS.

FIG. 2 illustrates the framing and windowing used. The output of the speech enhancement device is a processed version of the input signal with a total delay of one frame, i.e. in the present example 10 milliseconds.

Figure 3:
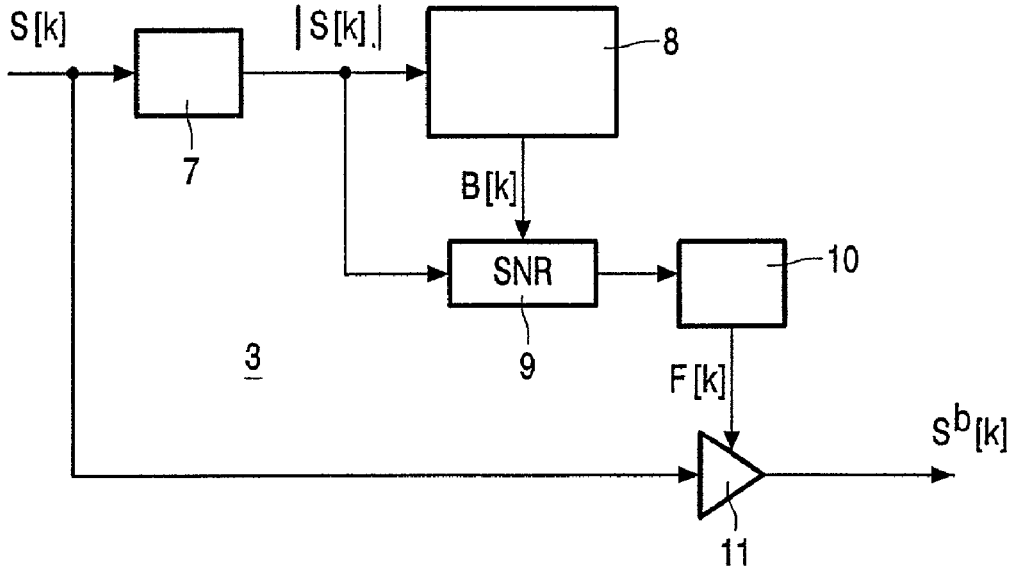
FIG. 3 is a block diagram of the frequency domain adaptive filtering in the BNS.

FIG. 3 shows a block diagram of the adaptive filtering in the frequency domain, comprising a magnitude block 7, a background level update block 8, a signal-to-noise ratio block 9, a filter update block 10 and processing means 11. The following operations are applied therein on each frequency component k of the spectrum S[k]. First, in the magnitude block 7 the absolute magnitude |S[k]| is computed using the relation $$|S[k]|=[(R\{S[k]\})^2+(I\{S[k]\})^2]^{1/2},$$

where R{S[k]} and I{S[k]} are respectively the real and imaginary parts of the spectrum with, in the present example $0 \leqq k \leqq 129$. Then, the background level update block uses the input magnitude |S[k]| to calculate the predicted background magnitude B[k] for the current frame.

A signal-to-noise ratio (SNR) is computed using the relation:

$$SNR[k]=|S[k]|/B[k]$$

and used by the filter update block 10 to calculate the filter magnitude F[k].

Finally, the filtering is done using the formulas:

$$R^b\{S^b[k]\}=R\{S[k]\}.F[k] \text{ and}$$

$$I^b\{S^b[k]\}=I\{S[k]\}.F[k].$$

It is assumed that the overall phase contribution of the background noise is evenly distributed over the real and imaginary part of the spectrum such that a local reduction of the amplitude in the frequency domain also reduces the added phase information. However, it can be argued whether it is enough to change the amplitude spectrum alone and not to alter the phase contribution of the background signal. If the background only consisted of a periodic signal, it would be easy to measure its amplitude and phase components and add a synthetic signal with the same periodicity and amplitude but with a 180° rotated phase. Since the phase contribution of a noisy signal over the analysis interval is not constant and since only the signal-to-noise ratio is measured, all that can be done is to suppress the energy of the input signal with a separate factor for each frequency region. This would normally not only suppress the background energy but also the energy of the speech signal. However, the elements of the speech signal important for perception normally have a larger signal-to-noise ratio than other regions, such that in practice the present method is sufficient enough.

Figure 4:
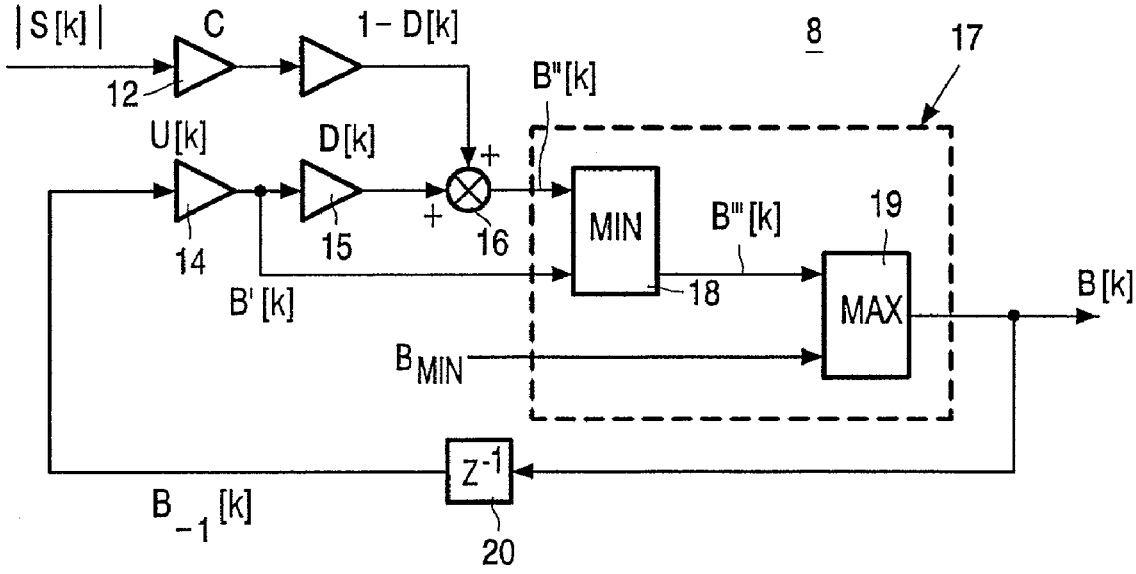
FIG. 4 is a block diagram of the background level update in the BNS.

FIG. 4 shows the background level update block 8 in more detail. Block 8 comprises processing means 12–16, comparator means 17 with comparators 18 and 19 and a memory unit 20.

The background level is updated in the following steps:

First, via the memory unit 20 and the processing means 14 the previous value of the background level $B_{-1}[k]$ is increased by a factor U[k] giving B'[k].

Then the outcome is compared to a value B"[k], which is a scaled combination of the increased background level B'[k] and the current absolute input level |S[k]| obtained via processing means 12, 13, 15 and 16. By means of the comparator 18 the smaller one is chosen as the candidate to the background level B'"[k].

Finally, by means of the comparator 19 the background level B'"[k] is restricted by the minimum allowed background level Bmin, giving the new background level. This is also the output of the background level update block 8.

So, the calculated background magnitude can be represented by the relation:

$$B[k]=\max\{\min\{B'[k], B''[k]\}, B_{min}\},$$

with $B_{min}$ the minimum allowed background level, while $$B'[k]=B_{-1}[k].U[k] \text{ and}$$

$$B''[k]=(B'[k].D[k])+(|S[k]|.C.(1-D[k])),$$

in which U[k] and D[k] are frequency dependent scaling factors and C a constant.

In the present embodiment the input scale factor C is set to 4. Bmin is set to 64. The scaling functions U[k] and D[k] are constant for each frame and depend only on the frequency index k. These functions are defined as:

$$U[k]=a+k/b \text{ and } D[k]=c-k/d,$$

where a may be set to 1.002, b to 16384, c to 0.97 and d to 1024.

Figure 5:
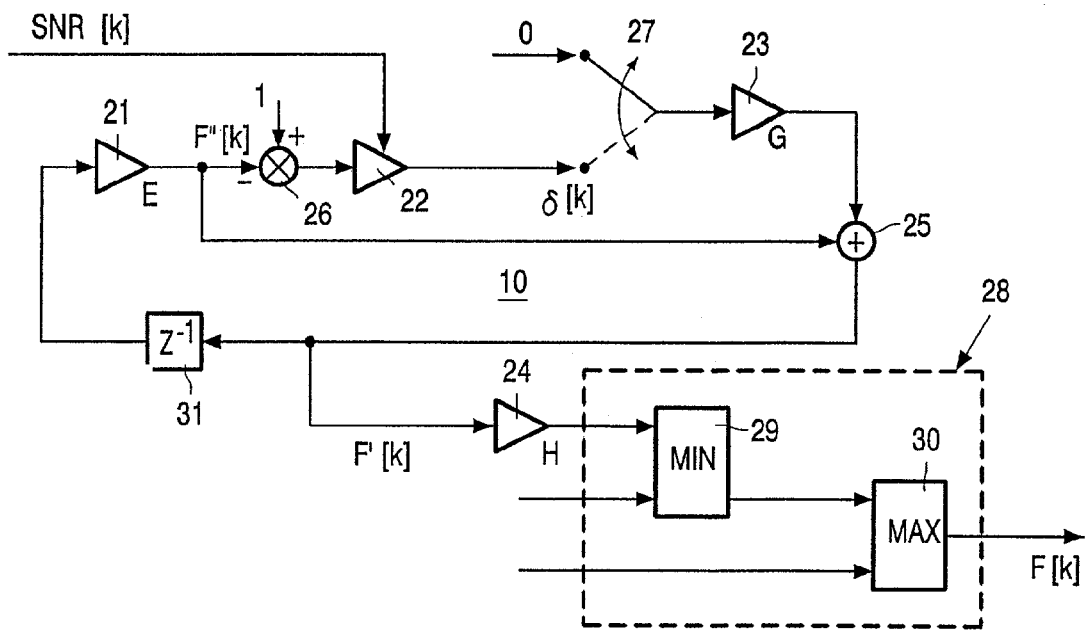
FIG. 5 is a block diagram of the filter update in the BNS.

FIG. 5 shows the filter update block 10 in more detail. Block 10 comprises processing means 21–27, comparator means 28 with comparators 29 and 30 and a memory unit 31.

Block 10 comprises two stages: one for the adaptation of the internal filter value F'[k] and one for the scaling and clipping of the output filter value. The adaptation of the internal filter value F'[k] is done by increasing the downscaled internal filter value of the previous frame by an input and filter-level dependent step value, according to the relations:

$$F''[k]=F'_{-1}[k].E,$$

$$\delta[k]=(1-F''[k]).SNR[k], \text{ and}$$

$$F'[k]=F''[k] \text{ if } \delta[k] \leqq 1, \text{ or } F'[k]=F''[k]+G.\delta[k] \text{ otherwise,}$$

where E may be set to 0.9375 and G may be set to 0.0416.

Scaling and clipping of the output filter value is done using:

$$F[k]=\max\{\min\{H.F'[k], 1\}, F_{min}\},$$

where H may be set to 1.5 and $F_{min}$ may be set to 0.2.

The reason for extra scaling and the clipping of the output filter is to have a filter that has a band-pass characteristic for spectral regions with significantly higher energy than the background.

FIG. 6 gives an illustration of the output of the background-level and filter update blocks for a frame of voiced speech segment contaminated with background noise.

The speech enhancement device with a stand-alone background noise subtractor (BNS) as described above may be applied in the encoder of a speech coding system, particularly a $P^2CM$ coding system. The encoder of said $P^2CM$ coding system comprises a pre-processor and an ADPCM encoder. The pre-processor modifies the signal spectrum of the audio input signal prior to encoding, particularly by applying amplitude warping, e.g. as described in: R. Lefebre, C. Laflamme; "Spectral Amplitude Warping (SAW) for Noise Spectrum Shaping in Audio Coding:, ICASSP, vol. 1, p. 335–338, 1997. As such an amplitude warping is performed in the frequency domain, the background noise reduction may be integrated in the pre-processor. After time-to-frequency transformation background noise reduction and amplitude warping are realized successively, whereafter frequency-to-time transformation is performed. In this case, the input signal of the speech enhancement device is formed by the input signal of the pre-processor. In the pre-processor this input signal is changed at such a manner that a noise reduction in the resulting signal is obtained, so that warping is performed with respect to noise reduced signals. The output of the pre-processor obtained in response to said input signal forms a delayed version of the input frame and is supplied to the ADPCM encoder. This delay, in the present example 10 milliseconds, is substantially due to the internal processing of the BNS. A further input signal for the ADPCM encoder is formed by a codec mode signal, which determines the bit allocation for the code words in the bitstream output of the ADPCM encoder. The ADPCM encoder produces a code word for each sample in the pre-processed signal frame. The code words are then packed into frames of, in the present example, 80 codes. Depending on the chosen codec mode, the resulting bitstream has bit-rate of e.g. 11.2, 12.8, 16, 21.6, 24 or 32 kbit/s.

The embodiment described above is realized by an algorithm, which may be in the form of a computer program capable of running on signal processing means in a $P^2CM$ audio encoder. In so far part of the figures show units to perform certain programmable functions, these units must be considered as subparts of the computer program.

The invention described is not restricted to the described embodiments. Modifications thereon are possible. Particularly it may be noticed that the values of a, b, c, d, E, G and H are only given as an example; other values are possible.

What is claimed is:

1. Speech enhancement device for the reduction of background noise, comprising a time-to-frequency transformation unit to transform frames of time-domain samples of audio signals to the frequency domain, background noise reduction means to perform noise reduction in the frequency domain, and a frequency-to-time transformation unit to transform the noise reduced audio signals from the frequency domain to the time-domain, characterized in that the background noise reduction means comprise a background level update block to calculate, for each frequency component in a current frame of the audio signals, a predicted background magnitude B[k] in response to the measured input magnitude S[k] from the time-to-frequency transformation unit and in response to the previously calculated background magnitude $B_{-1}[k]$, a signal-to-noise ratio block to calculate, for each of said frequency components, the signal-to-noise ratio SNR[k] in response to the predicted background magnitude B[k] and in response to said measured input magnitude S[k] and a filter update block to calculate, for each of said frequency components, the filter magnitude F[k] for said measured input magnitude S[k] in response to the signal-to-noise ratio SNR[k]; wherein the previously predicted background magnitude is updated according to the relation: $B[k]=\max\{\min\{B'[k], B''[k]\}, B_{min}\}$, with $B_{min}$ the minimum allowed background level, while $B'[k]=B_{-1}[k]$. U[k] and $B''[k]=(B'[k].D[k])+(|S[k]|.C.(1-D[k]))$, in which U[k] and D[k] are frequency dependent scaling factors and C a constant.

2. Speech enhancement device according to claim 1, characterized in that the signal-to-noise ratio block comprises means to calculate the signal-to-noise ratio SNR[k] in response to the predicted background magnitude B[k] and to the measured input magnitude S[k] according to the relation: $SNR[k]=|S[k]|/B[k]$.

3. Speech enhancement device according to claim 1, characterized in that the filter update block comprises first means to calculate an internal filter value F'[k] and second means to derive therefrom the filter magnitude for the measured input magnitude, the first means comprising a memory unit to obtain a previously calculated internal filter magnitude $F'_{-1}[k]$ and processing means to update the previously calculated internal filter magnitude.

4. Speech enhancement device according to claim 3, characterized in that the second means comprise comparator means for scaling and clipping the filter magnitude according to the relation: $F[k]=\max\{\min\{H.F'[k], 1\}, F_{min}\}$, where H is a constant, $F_{min}$ a minimal filter value and F'[k] the internal filter value.

5. Speech encoder for a speech coding system, particularly for a $P^2CM$ audio coding system, provided with a speech enhancement device according to claim 1.

6. Speech coding system, particularly a $P^2CM$ audio coding system, provided with a speech encoder having a speech enhancement device according to claim 1.

7. $P^2CM$ audio coding system with a $P^2CM$ encoder comprising a pre-processor including spectral amplitude warping means and an ADPCM encoder, characterized in that the pre-processor is provided with a speech enhancement device according to claim 1, the speech enhancement device having background noise reduction means, integrated in the spectral amplitude warping means of the pre-processor.

* * * * *